US009777525B2

(12) United States Patent
Salice

(10) Patent No.: US 9,777,525 B2
(45) Date of Patent: Oct. 3, 2017

(54) DECELERATED HINGE FOR FURNITURE

(71) Applicant: Arturo Salice S.P.A., Novedrate (Como) (IT)

(72) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 0 days.

(21) Appl. No.: 14/900,383

(22) PCT Filed: Sep. 9, 2014

(86) PCT No.: PCT/EP2014/069147
§ 371 (c)(1),
(2) Date: Dec. 21, 2015

(87) PCT Pub. No.: WO2015/039922
PCT Pub. Date: Mar. 26, 2015

(65) Prior Publication Data

US 2016/0153224 A1 Jun. 2, 2016

(30) Foreign Application Priority Data

Sep. 19, 2013 (IT) ..... MI2013A1542

(51) Int. Cl.
*E05F 1/08* (2006.01)
*E05F 3/20* (2006.01)
(Continued)

(52) U.S. Cl.
CPC ..... *E05F 3/20* (2013.01); *E05D 3/16* (2013.01); *E05F 3/10* (2013.01); *E05F 5/006* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 4,075,735 A * 2/1978 Rock ..... E05D 11/1021 16/278
5,058,238 A * 10/1991 Lautenschlager ..... E05D 3/16 16/278
(Continued)

FOREIGN PATENT DOCUMENTS

DE 20200762 4/2002
DE 102010006816 8/2011
(Continued)

OTHER PUBLICATIONS

European Office Action dated Mar. 30, 2016; European Application No. 14771812.6; 5 pages.
(Continued)

*Primary Examiner* — Chuck Mah
(74) *Attorney, Agent, or Firm* — Blank Rome LLP

(57) ABSTRACT

A hinge (10) for mounting a door on a piece of furniture or the like comprises a hinge arm (11) securable to a fixed part (12) of the piece of furniture, a box (14) securable to a door of the piece of furniture and connected to the hinge arm (11) by an articulation system (15) comprising a plurality of swinging connecting levers and spring means (27) acting in the closing direction of the hinge (10); the hinge (10) further comprises a decelerating device (29) comprising a housing body (30), supported and configured in such a way so as to be disposed at one of the front or side walls (11', 11") of the hinge arm (11), and a linearly movable actuating member
(Continued)

(31) actuatable by one (18) of the swinging connecting levers of the articulation system (15) of the hinge.

22 Claims, 2 Drawing Sheets

(51) Int. Cl.
*E05D 3/16* (2006.01)
*E05F 5/00* (2017.01)
*E05F 5/02* (2006.01)
*E05F 3/10* (2006.01)

(52) U.S. Cl.
CPC ..... *E05F 5/02* (2013.01); *E05Y 2201/21* (2013.01); *E05Y 2201/254* (2013.01); *E05Y 2201/256* (2013.01); *E05Y 2201/264* (2013.01); *E05Y 2201/412* (2013.01); *E05Y 2600/456* (2013.01); *E05Y 2900/20* (2013.01)

(58) Field of Classification Search
CPC ..... E05Y 2201/21; E05Y 2201/254; E05Y 2201/264; E05Y 2201/412; E05F 5/006; E05F 5/02; E05F 3/20; E05D 11/1021; E05D 11/1042; E05D 11/105; E05D 11/1064; E05D 7/04; E05D 7/0407; E05D 7/125; E05D 3/142; E05D 3/16
See application file for complete search history.

(56) References Cited

U.S. PATENT DOCUMENTS 5,450,655 A * 9/1995 Ferrari ..... E05D 3/16 16/368
6,408,483 B1 * 6/2002 Salice ..... E05F 5/02 16/82
6,591,454 B2 * 7/2003 Brustle ..... E05F 5/006 16/374
7,234,569 B2 * 6/2007 Salice ..... E05F 5/006 16/85
7,406,749 B2 * 8/2008 Herper ..... E05F 5/006 16/286
7,552,509 B2 * 6/2009 Chen ..... E05F 5/10 16/286
7,712,185 B2 * 5/2010 Pyo ..... E05F 5/006 16/250
7,814,618 B2 * 10/2010 Lautenschlager ..... E05F 5/006 16/250
7,861,376 B2 * 1/2011 Fitz ..... E05D 3/16 16/286
8,225,459 B2 * 7/2012 Waltemate ..... E05D 3/16 16/286
8,468,651 B2 * 6/2013 Lautenschlager ..... E05F 5/02 16/82
8,601,644 B1 * 12/2013 Chen ..... E05F 5/006 16/286
8,713,760 B2 * 5/2014 Krudener ..... E05D 3/16 16/370
8,925,151 B2 * 1/2015 Salice ..... E05F 5/006 16/286
2003/0200625 A1 * 10/2003 Zimmer ..... F16F 9/0209 16/306
2004/0205935 A1 * 10/2004 Lautenschlaeger ..... E05D 3/142 16/374
2005/0015927 A1 * 1/2005 Kropf ..... E05D 3/142 16/286
2008/0168620 A1 * 7/2008 Hammerle ..... E05F 5/006 16/85
2009/0165244 A1 7/2009 Pyo
2011/0225768 A1 * 9/2011 Haemmerle ..... E05D 3/16 16/49
2012/0180262 A1 * 7/2012 Zimmer ..... E05F 5/006 16/319
2013/0055528 A1 * 3/2013 Lowe ..... E05F 5/08 16/85
2013/0239363 A1 * 9/2013 Apur ..... E05F 5/006 16/50
2014/0352111 A1 * 12/2014 Ng ..... E05F 5/02 16/286
2016/0024829 A1 * 1/2016 Lowe ..... E05F 5/006 16/85

FOREIGN PATENT DOCUMENTS

EP 1359275 11/2003
FR 2506376 11/1982
JP 08291665 A * 11/1996
JP 2000310080 A * 11/2000
KR 20080086135 A * 9/2008
KR 100871650 B1 * 12/2008
KR 20120092406 A * 8/2012
WO 8905388 6/1989
WO WO2006/053364 5/2006
WO 2007025316 3/2007
WO WO 2008020682 A1 * 2/2008 ..... E05F 5/006

OTHER PUBLICATIONS

International Search Report dated Oct. 17, 2014; International Application No. PCT/EP2014/069147; International Filing Date: Sep. 9, 2014; 4 pages.
Written Opinion dated Oct. 17, 2014; International Application No. PCT/EP2014/069147; International Filing Date: Sep. 9, 2014; 5 pages.
English translation dated Oct. 28, 2015; German Application No. DE20200762; 6 pages.
English translation dated Nov. 12, 2015; German Application No. DE102010006816; 11 pages.
English translation dated Oct. 27, 2015; European Application No. EP1359275; 13 pages.
English translation dated Oct. 26, 2015; International Publication No. WO1988/005388; 9 pages.
English translation dated Oct. 26, 2015; International Publication No. WO2007/025316; 8 pages.
English abstract dated Oct. 28, 2015; French Application No. FR2506376; 1 page.

* cited by examiner

DECELERATED HINGE FOR FURNITURE

BACKGROUND OF THE INVENTION

The invention relates to a decelerated hinge for doors of pieces of furniture or the like, in particular a hinge provided with a decelerating device suitable for decelerating the closing movement of the hinge itself.

PRIOR ART

In the furniture industry, the doors of pieces of furniture are commonly supported in a swingable fashion by hinges comprising a fixed part connectable to the body of the piece of furniture and a movable part, consisting of a box connectable to the door; the parts are swingably joined to each other, for example by means of an articulation system comprising a plurality of connecting levers.

The hinges further comprise suitable spring means, for example leaf or wire springs, in order to draw the hinge in the closing direction.

However, due to the presence of the spring means, the door, when arriving in the closing position, forcefully impacts the body of the piece of furniture, causing undesired noise.

To overcome this problem, it has been variably proposed to adopt decelerating devices, for example associated with one of the parts of the hinge, to dampen the closing movement of the hinge itself; these devices can be of a linear type or a rotational type and use a fluid or a grease as the braking means.

In particular, in the case of hinges with an articulation system comprising two connecting arms and four articulation axes, EP 1199433, for example, discloses the application of a decelerating device of a fluid linear type on the fixed part of the hinge; the device has an actuating member configured and disposed so as to be actuated by the door or by the movable part of the hinge secured to the door itself. This solution is simple, but it is not suitable, for example, for hinges with an articulation system having four connecting levers and seven articulation axes, in which, because of the configuration of the articulation system itself, the actuating member cannot be disposed in such a way as to come into contact with the door or with the movable part of the hinge connected thereto.

For this type of hinge, WO 2006/053364, for example discloses the application of a decelerating device on one of the connecting levers in such a way that the actuating member can be pressed by a second connecting lever adjacent to the previous one; however, such a solution entails a considerable amount of space occupied by the decelerating device inside the piece of furniture and a greater constructive complexity of the articulation system and it is not applicable to all types of hinges with seven articulation axes.

Alternatively, it has been proposed to apply a decelerating device to the movable part of the hinge in such a way as to be actuated by a lever of the articulation system; however, the presence of the decelerating device inside the door constitutes a bothersome obstacle or an impediment in the normal use of the piece of furniture and is thus not desirable.

There is thus a need to be able to apply a decelerating device in a simple manner to a hinge in cases in which the actuating member of the device itself cannot come into contact with the movable part of the hinge or with the door in order to be actuated, while maintaining limited overall dimensions at the same time.

OBJECTS OF THE INVENTION

The main object of the present invention, is thus to provide a hinge for furniture doors or the like having a decelerating device of a linear type that can be applied in a simple manner and is configured and disposed in a manner such as to provide an effective decelerating action in cases in which the actuating member of the device itself cannot come into contact with the movable part of the hinge or with the door in order to actuate it.

A further object is to provide a hinge for furniture doors or the like having a decelerating device of a linear type which occupies limited space inside the piece of furniture and does not entail impediments to use deriving from the presence of additional elements on the door.

BRIEF DESCRIPTION OF THE INVENTION

All the above is achievable by means of a hinge for mounting a door on a piece of furniture or the like, comprising:

- a hinge arm having a front wall and side walls, the arm being securable to a fixed part of the piece of furniture;
- a box securable to a door of the piece of furniture and connected to hinge arm by an articulation system comprising a plurality of movable connecting levers;
- a spring means acting in closing direction of the hinge; and
- a decelerating device comprising a housing body and a actuating member linearly movable according to a longitudinal axis, characterized in that said housing body is supported and configured in such a way as to be disposed on one of said walls of the hinge arm, and in that the actuating member of said decelerating device is configured and arranged so as to be actuatable by one of said connecting levers of the articulation system of the hinge.

Additional features of the present invention are moreover defined in the subsequent claims.

BRIEF DESCRIPTION OF THE DRAWINGS

The features and advantages of the present invention will be more apparent from the following description of a preferential but non-limiting embodiment of the hinge with a decelerating device for furniture, with reference to the appended figures, in which.

DETAILED DESCRIPTION OF THE INVENTION

Figure 1:
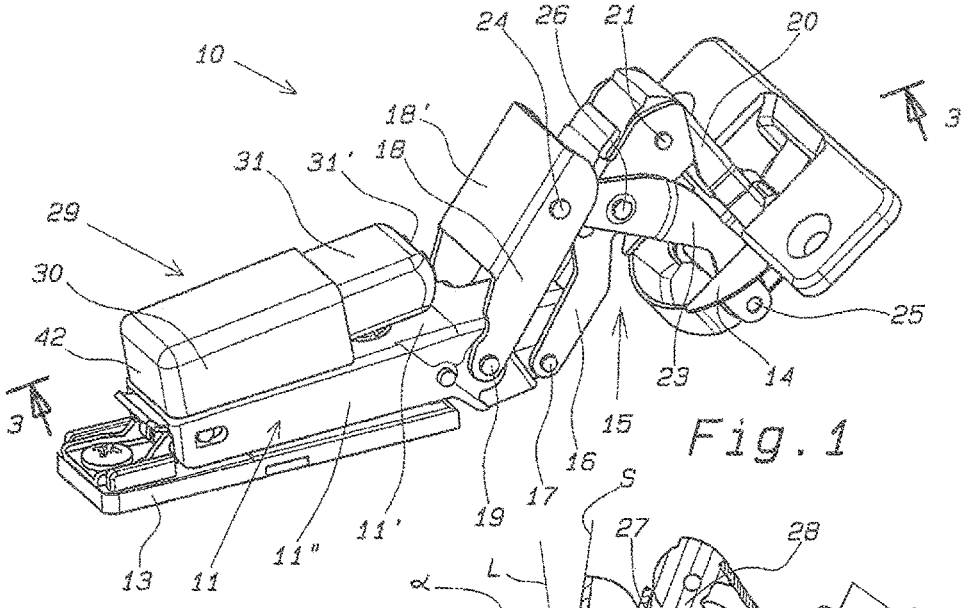
FIG. 1 is a perspective view of the hinge according to an embodiment of the invention with the decelerating device mounted on the fixed part thereof.
Figure 3:
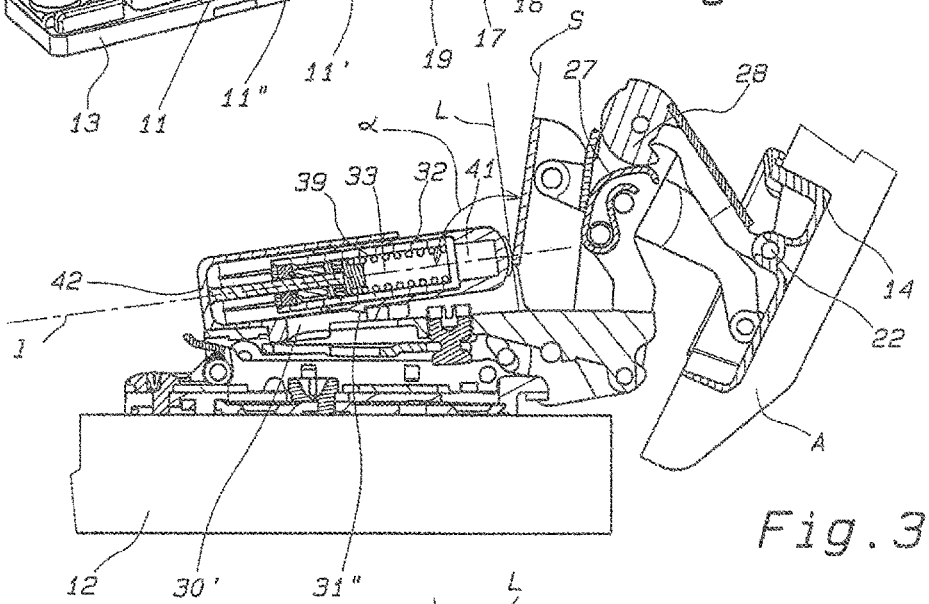
FIG. 3 is a longitudinal section view of the hinge with a decelerating device in FIG. 1 according to the line 3-3, at a closing angle of the hinge in which the decelerating device begins performing its function.
Figure 4:
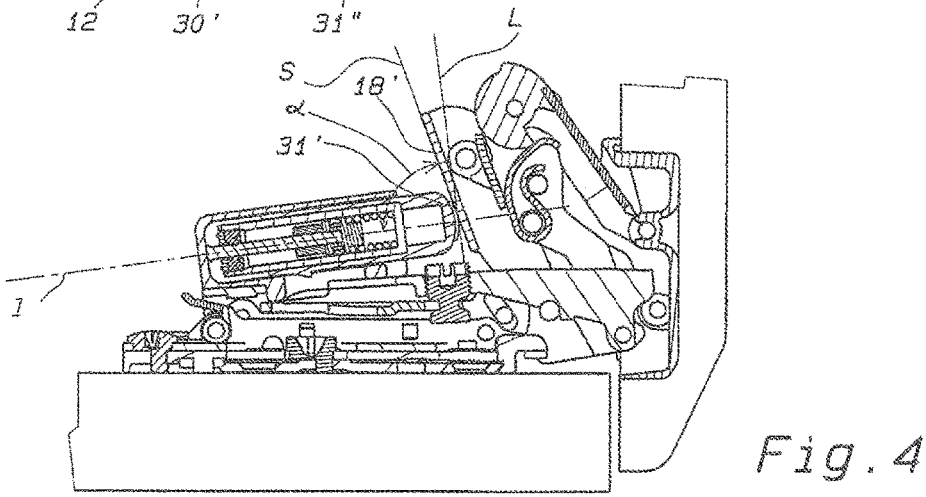
FIG. 4 is the longitudinal section view of FIG. 3, in the position of complete closing of the hinge.
Figure 5:
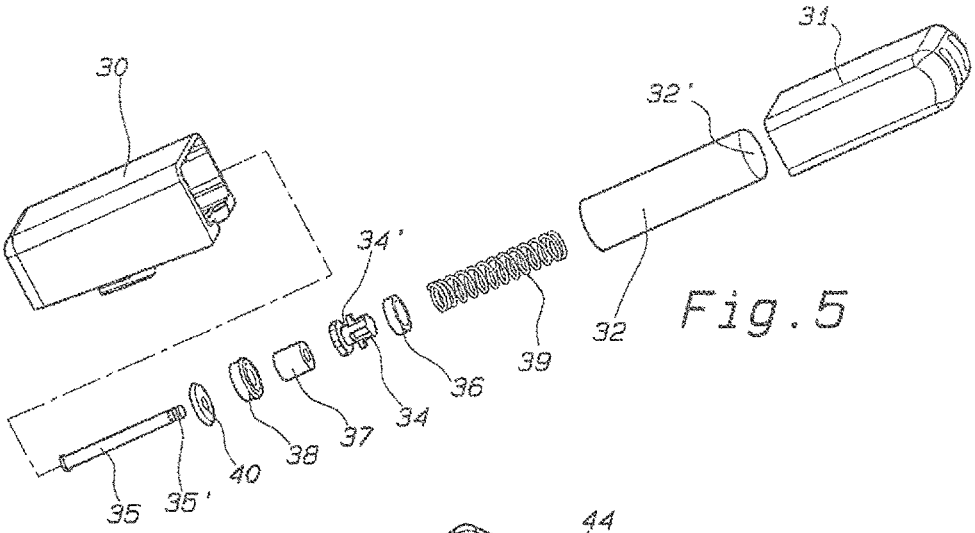
FIG. 5 is an exploded perspective view of an example embodiment of the decelerating device in FIG. 1.

The hinge for mounting a door on a piece of furniture, according to the present invention, indicated overall in the appended figures with the numerical reference 10, in general comprises a hinge arm 11 securable to a side wall 12 of the piece of furniture defining a fixing surface or to another fixed part of the piece of furniture by means of a conventional separate fixing base 13 applicable to the side wall 12 of the piece of furniture.

The arm 11 has a front wall 11' and two side walls 11" that extend according to a longitudinal axis of the arm itself, defining a C-shaped cross section.

The hinge 10 further comprises a hinge box 14 securable to a door A of the piece of furniture and connected to the hinge arm 11 by an articulation system 15 comprising a plurality of movable connecting levers to enable the hinge to move between an open position and a closed position of the door A.

Preferably, the connecting levers are swingably movable between each other, but it is not ruled out that the articulation system can also comprise sliding elements, such as a sliding block or the like.

In the preferred embodiment illustrated, the articulation system 15 is of the type comprising seven articulation axes, which enables wide door opening angles to be obtained, for example equal to or greater than 110°, as well as specific movements for the doors themselves, necessary, for example, to allow the opening of doors with particular profiles or made of glass or the like.

In particular, the preferred articulation system 15 comprises a first connecting lever 16 joined to a front end of the hinge arm 11 turned toward the door of the piece of furniture by a first pin 17, and also comprises a second connecting lever 18, likewise joined to a front end of the hinge arm 11 by a second pin 19 spaced from the previous one in the direction of the rear end of the arm 11 itself.

Preferably, the ratio between the length of the hinge arm 11 and the distance between the first pin 17 and the second pin 18 is for example comprised from 4 to 8.

The first connecting lever 16, at the end opposite the first pin 17, is joined to a third connecting lever 20 by a third pin 21 to a first end of the third lever itself; at the opposite end the third lever 20 is joined to the box 14 by a fourth pin 22 placed in the front part of the box 14 itself.

The second connecting lever 18, at the end opposite end of the second pin 19, is joined to a fourth connecting lever 23 by a fifth pin 24 at a first end of the fourth lever itself; at the end opposite end the fourth lever 23 is joined to the box 14 by a sixth pin 25 placed in the rear part of the box 14 itself.

Finally, the first connecting lever 16 and fourth connecting lever 23 are joined to each other in an intermediate point thereof by a seventh articulation pin 26.

The hinge 10 likewise comprises a spring means acting in a closing direction of the hinge, and which preferably comprises a C-shaped leaf spring 27 mounted integrally with the first connecting lever 16; the spring 27 has an arm that cooperates with and acts on a cam 28 integral with the third connecting lever 20. According to the present invention, the hinge comprises a decelerating device 29 having a housing body 30, supported and configured in such a way as to be disposed on one of the front 11' or side 11" walls of the hinge arm 11, and an actuating member 31 linearly movable according to a longitudinal axis 1, the member 31 being configured and disposed so as to be actuatable by one 18 of the connecting levers of the articulation system 15 of the hinge.

The longitudinal axis 1 of the actuating member 31 and the longitudinal axis of the hinge arm 11 preferably lie in a plane orthogonal to the surface of the door 14 and to the fixing surface of the arm 11 itself and can be substantially parallel or inclined relative to each other.

In the preferred embodiment illustrated, the housing body 30 is supported by or secured to the front wall 11' of the arm 11 at the rear end thereof, whilst the actuating member 31, which protrudes from the aforesaid body 30 in the direction of the front end of the arm 11, is directly actuated by the second connecting lever 18 joined to the hinge arm 11 in a more rearward position and thus closer to the actuating member 31 itself.

It is not ruled out, however, that the actuating member 31 can be actuated by a different connecting lever, for example by the first lever 16, through a suitable configuration of the actuating member 31 and/or of the articulation system 15 as a whole.

Alternatively, the housing body 30 can be secured in a different manner, for example to one of the side walls 11" of the arm 11, to the base 13, to an adjustment plate interposed between the arm 11 and the fixing base 13, or to the side wall 12 of the piece of furniture, though it must have a configuration such as to be disposed in any case on the front wall 11' of the hinge arm 11 in order to be actuated by the second connecting lever 18 of the articulated system 15.

According to a different unillustrated embodiment, the housing body 30 can be supported and configured in such a way as to be disposed on one of the side walls 11" of the hinge arm 11; in this case the actuating member 31 of the decelerating device 29 is configured and disposed so as to be actuatable by a wing or lateral extension of one of the connecting levers 16, 18, 20, 23 of the articulation system 15 of the hinge, preferably of the lever 18.

In this case as well, the housing body 30 can be fixed in different ways, for example to the front wall 11' or to one of the side walls 11" of the arm 11, to the base 13, to an adjustment plate interposed between the arm 11 and the fixing base 13, or to the side wall 12 of the piece of furniture, though it must have a configuration such as to be disposed in any case on the front wall 11' of the hinge arm 11 in order to be actuated by the lateral wing of the second connecting lever 18 of the articulated system 15.

The actuating member 31 is axially inserted in the housing body 30 and has coupling means, for example in the form of a tooth 31" engageable with an opening 30' of the housing body 30, in order to keep the member 31 and the body 30 slidingly engaged with each other.

The connecting lever 18 has a thrust surface 18' for the actuating member 31 of the decelerating device, the surface 18' preferably being configured and disposed so as to act on the actuating member 31 along a swinging arc which extends in the neighbourhood of a plane orthogonal to the longitudinal axis 1 of the actuating member 31 itself, in particular the plane orthogonal L passing through the front end of the actuating member 31.

It is not ruled out, however, that the decelerating device 29 can be mounted in such a way that the longitudinal axis 1 of the actuating member 31 is inclined relative to the oscillation plane of the connecting lever 18, it being understood that the thrust surface 18' must act on the actuating member 31 with at least a thrust component parallel to the longitudinal axis 1 itself.

Preferably, in the illustrated embodiment the thrust surface 18', during the end part of the closing movement of the hinge in which the box 14 swings, for example, from an opening position comprised from 15° to 30° to the complete closing position of the hinge, acts on a contact surface 31' of the actuating member 31 in a series of points belonging to planes S tangent to the same contact surface 31', the planes S progressively assuming angles α starting from an initial value comprised in the interval from −25° to −12° to a final value comprised in the interval from +12' to +25° relative to the plane orthogonal L to the axis 1 of the actuating member 31.

More preferably, the initial value of the aforesaid angles is comprised in the interval from −20° to −16°, whilst the final value is comprised in the interval from +14° to +18° relative to the plane orthogonal to the axis of the actuating member 31.

In this manner, a substantially linear decelerating effect is achieved; it is not ruled out, however, that different angles can be provided for to obtain a decelerating effect with a different trend, for example, a smaller initial value in absolute terms and a larger final angle in order to obtain an increasing decelerating effect or vice-versa.

In the illustrated embodiment, the thrust surface 18' is flat, whereas the contact surface 31' has an arcuate cross section along a plane orthogonal to the articulation axis 19 and passing through the longitudinal axis of the actuating member 31 of the decelerating device; it is not ruled out, however, that the thrust surface 18' and the contact surface 31' can be differently shaped depending on the decelerating action it is desired to obtain.

The housing body 30 of the decelerating device 29 can be made as a separate element applied externally to the hinge arm 11 or in a single piece with the arm 11. Preferably, the longitudinal axis of the actuating member 31 is inclined by an angle comprised from 5° to 15' relative, to the fixing surface for the hinge arm 11.

The decelerating device 29 is preferably of the fluid linear type, for example, using oil, air or grease, and in the illustrated embodiment it comprises a cylinder 32 defining a chamber 33 for the fluid, in this specific case oil; in the chamber 33 there is a slidingly movable piston 34, which has an axial rod 35 and an annular groove 34', in which is an annular gasket 36 is disposed.

In the illustrated embodiment, the actuating member 31 and the cylinder 32 are configured as separate pieces; it is not ruled out, however, that they can be made in one piece.

Analogously, the axial rod 35 is a piece separate from the housing body 30; it is not ruled out, however, that they can be made in one piece.

The decelerating device 29 further comprises an annular volume compensating element 37, for example made of closed-cell rubber, and also comprises an annular sealing gasket 38 between the piston rod 35 and an inner surface of the piston chamber 33.

Finally, there are provided spring return means, for example in the form of a helical spring 39 that extends in the chamber 33 between a front wall 32' of the cylinder 32 and the piston 34 of the decelerating device, and an annular closing cover 40 for the chamber 33, securable to the rear end of the cylinder 32.

The piston rod 35 extends through the cover 40, the sealing gasket 38 and the volume compensating element 37 and has a front end that is press-fitted in a blind axial hole on a rear end of the piston 34; in order to obtain a more secure engagement, the piston rod 35 preferably has a peripheral knurling or serration 35' on the end to be inserted into the axial hole of the piston 34.

The cylinder 32 as a whole is fitted into an axial seat 41 provided in the actuating member 31 in such a way that the rear end of the rod 35 projects from the actuating member 31 itself so as to come into contact with a rear wall 42 of the housing body 30.

Preferably the chamber 33 has at least one passage groove, not illustrated, for the fluid extending longitudinally along at least part of the inner surface of the chamber 33 of the cylinder 32.

In order to achieve a modulation of the decelerating effect, the opening of the fluid passage groove can have a variable cross section along its longitudinal extension. The annular groove 34' of the piston 34 is disposed between a front wall and a rear wall of the piston; preferably, the rear wall has peripheral fluid passages having a larger opening size than the fluid passages provided on the front wall of the piston 34.

The annular gasket 36 is disposed in the groove 34' with axial and radial play, whilst the outer surface of the gasket 36 itself is adherent to the inner surface of the chamber 33 of the cylinder 32.

It is not ruled out that in other embodiments the actuating member 31 can be movably connected by means of a toothed pinion and rack to a known rotational type of deceleration device housed in the body 30.

Figure 6:
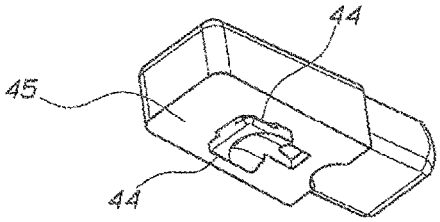
FIG. 6 is a detail of the preferential means for securing the decelerating device to the fixed part of the hinge.
Figure 2:
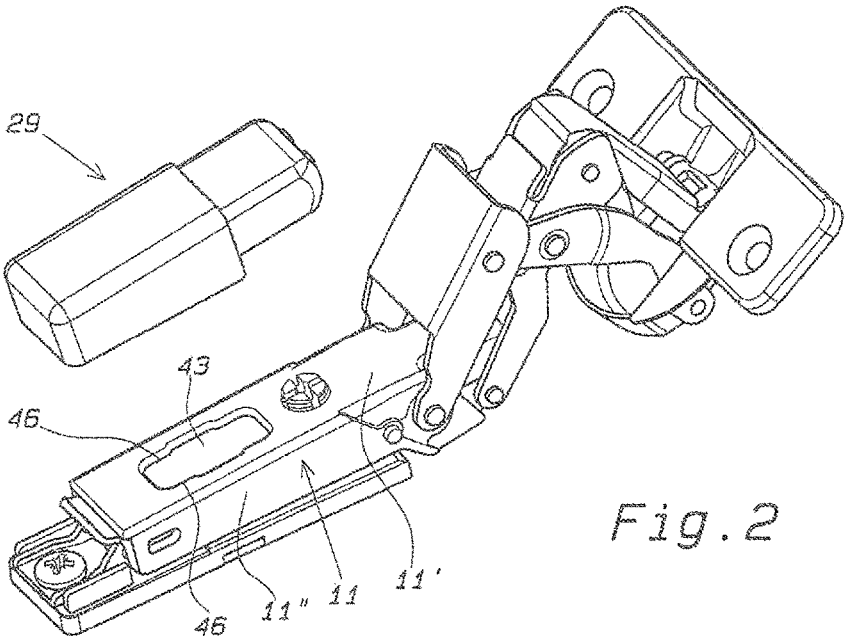
FIG. 2 is the hinge of FIG. 1 with the decelerating device detached from the fixed part of the hinge.

As better illustrated in FIGS. 2 and 6, the housing body 30 comprises quick fixing means engageable with an opening 43 provided on the hinge arm 11.

Preferably, the quick fixing means comprise longitudinal opposing wings 44 protruding from a lower wall 45 of the housing body 30 so as to be slidingly engageable with lateral opposing edges 46 of the opening 43 of the hinge arm 11 by means of an axial sliding movement of the decelerating device toward the rear end of the hinge arm 11.

However, different solutions for the quick fixing means are not ruled out; for example, said means can comprise a fixed element, which protrudes from the lower wall of the housing body, and a movable fixing element which is slidingly supported by the housing body so as to be movable from a retracted position to a position of protruding from the lower wall of the housing body itself.

A means is also provided to bring the movable fixing element from the retracted position to the protruding position, for example specific wedge-like surfaces on the movable element which are configured and disposed in such a way as to interact with the actuating member during the insertion thereof into the housing body in order to push the movable element into the protruding position, causing an engagement of the housing body with the hinge arm.

From the foregoing description it is evident how the decelerated hinge according to the invention has a decelerating device that can be simply applied and is configured in such a way as to provide an effective decelerating action in the cases in which, for example in hinges with 7 pins, the actuating member of the device cannot come into contact with the movable part of the hinge or with the door in order actuate it.

Furthermore, the hinge with a decelerating device according to the invention occupies limited space inside the piece of furniture and does not entail impediments to use deriving from the presence of additional elements on the door. The hinge according to the invention is susceptible of modifications and variants falling within the scope of the inventive concept; moreover, the constructive details can be replaced by technically equivalent elements.

The invention claimed is:

1. A hinge (10) for mounting a door (A) on a piece of furniture or the like, comprising:

a hinge arm (11) having a front wall (11') and side walls (11"), the arm (11) is secured and is non-movably fixed directly to a fixed part (12) of the piece of furniture;

a box (14) securable to a door (A) of the piece of furniture and connected to the hinge arm (11) by an articulation system (15) comprising four movable connecting levers (16, 18, 20, 23), two (16, 18) of the four movable connecting members (16, 18, 20, 23) being parallel over their range of motion;

spring means (27) acting in the closing direction of the hinge; and a decelerating device (29) comprising a housing body (30) and an actuating member (31) linearly movable according to a longitudinal axis (1), characterized in that said housing body (30) is supported and conformed in such a way as to be arranged at one of said walls (11', 11") of the hinge arm (11), and in that the actuating member (31) of said decelerating device (29) is conformed and arranged so as to be actuatable by one (18) of said connecting levers (16, 18, 20, 23) of the articulation system (15) of the hinge, and in that said articulation system (15) is of the type comprising seven articulation axes (17, 19, 21, 22, 24, 25, 26).

2. The hinge (10) according to claim 1, characterized in that said housing body (30) is supported in such a way as to be arranged at said front wall (11') of the hinge arm (11).

3. The hinge (10) according to claim 1, characterized in that said housing body (30) is supported in such a way as to be arranged at one of said side walls (11") of the hinge arm (11).

4. The hinge (10) according to claim 3, characterized in that the actuating member (31) of said decelerating device (29) is conformed and arranged so as to be actuatable by a side wing or projection of one (18) of said connecting levers (16, 18, 20, 23) of the articulation system (15) of the hinge.

5. The hinge (10) according to claim 1, characterized in that said housing body (3) is secured at said front wall (11') of the hinge arm (11).

6. The hinge (10) according to claim 1, characterized in that said housing body (30) is secured at one of said side walls (11") of the hinge arm (11).

7. The hinge (10) according to claim 1, in which said hinge arm (11) is securable to said fixed part (12) of the piece of furniture by a fixing base (13), characterized in that said housing body (30) is secured to said fixing base (13).

8. The hinge (10) according to claim 1, characterized in that said housing body (30) is secured to said fixed part (12) of the piece of furniture.

9. The hinge (10) according to claim 1, in which said one connecting lever (18) of a said connecting levers (16, 18, 20, 23) has a thrust surface (18') for said actuating member (31) of the decelerating device (29), characterized in that said thrust surface (18') is conformed and arranged for acting on said actuating member (31) along a swinging arc extending in the neighborhood of a plane orthogonal to said longitudinal axis of the actuating member (31).

10. The hinge (10) according to claim 9, characterized in that said thrust surface (18'), during the end part of the closing movement of the hinge (10) acts on a contact surface (31') of the actuating member (31) in a series of points belonging to planes (S) tangent to the same contact surface (31'), the planes (S) progressively assuming angles ($\alpha$) starting from an initial value comprised in the interval from −25° to −12° to a final value comprised in the interval from +12° to +25° with respect the plane (L) orthogonal to the axis (1) of the actuating member (31).

11. The hinge (10) according to claim 10, characterized in that said initial value is comprised in the interval from −20° to −16° and said final value is comprised in the interval from +14° to +18° with respect to the plane orthogonal to the axis of the actuating member (31).

12. The hinge (10) according to claim 1, characterized in that said housing body (30) is a separate element applied externally on said hinge arm (11).

13. The hinge (10) according to claim 1, characterized in that said housing body (30) is integral with said hinge arm (11).

14. The hinge (10) according to claim 1, in which said fixed part (12) of the piece of furniture has a fixing plane for the hinge arm, characterized in that said longitudinal axis of the actuating member (31) is sloped at an angle comprised from 5° to 15° with respect to the fixing plane for the hinge arm (11).

15. The hinge (10) according to claim 1, characterized in that said decelerating device (29) is of the fluid linear type.

16. The hinge (10) according to claim 15, characterized in that said decelerating device (29) comprises:

a cylinder (32) defining a chamber (33);

a piston (34) in said chamber (33), the piston (34) having an axial rod (35) and an annular groove (34');

an annular gasket (36) arranged in said groove (34') of the piston (34);

an annular volume compensating element (37);

an annular sealing gasket (38) between the axial rod (35) and an inner surface of the chamber (33);

spring return means (39); and an annular closing cover (40) for said chamber (33), securable to a rear end of the cylinder (32), said axial rod (35), extending through the annular closing cover (40), the annular sealing gasket (38) and the volume compensating element (37), to be press-fitted in a blind axial hole of said piston (34).

17. The hinge (10) according to claim 16, characterized in that said cylinder (32) is fitted in an axial seat (41) provided in said actuating member (31).

18. The hinge (10) according to claim 16, characterized in that said chamber (33) has at least one passage groove for the fluid longitudinally extending along at least part of the inner surface of the cylinder chamber (33).

19. The hinge (10) according to claim 16, characterized in that said spring return means comprises a helical spring (39) extending in said chamber (33) between a front wall (32') of the cylinder (32) and said piston (34) of the decelerating device (29).

20. The hinge (10) according to claim 1, characterized in that said housing body (30) comprises quick fixing means engageable with an opening (43) provided on said hinge arm (11).

21. The hinge (10) according to claim 20, characterized in that said quick fixing means comprises lateral opposing wings (44) protruding from a lower wall (45) of said housing body (30) to be slidingly engageable with lateral opposing edges (46) of said opening (43) of the hinge arm (11).

22. The hinge (10) according to claim 1, characterized in that five (17, 19, 21, 24, 26) of the seven articulation axes (17, 19, 21, 22, 24, 25, 26) are located on the two parallel connecting members (16, 18).

* * * * *